US007541965B2

(12) United States Patent
Ouchi et al.

(10) Patent No.: US 7,541,965 B2
(45) Date of Patent: Jun. 2, 2009

(54) APPLIANCE CONTROL APPARATUS

(75) Inventors: Kazushige Ouchi, Kanagawa-ken (JP); Takuji Suzuki, Kanagawa-ken (JP); Akihisa Moriya, Tokyo (JP)

(73) Assignee: Kabuhsiki Kaisha Toshiba, Tokyo (JP)

( * ) Notice: Subject to any disclaimer, the term of this patent is extended or adjusted under 35 U.S.C. 154(b) by 309 days.

(21) Appl. No.: 11/432,489

(22) Filed: May 12, 2006

(65) Prior Publication Data

US 2006/0262001 A1 Nov. 23, 2006

(30) Foreign Application Priority Data

May 16, 2005 (JP) ..... 2005-143051

(51) Int. Cl.
*G08C 17/00* (2006.01)

(52) U.S. Cl. ..... 341/176; 340/825.19; 74/471 XY

(58) Field of Classification Search ..... 341/20, 341/176; 340/825.19
See application file for complete search history.

(56) References Cited

U.S. PATENT DOCUMENTS 6,072,467 A * 6/2000 Walker ..... 345/157
7,167,122 B2 * 1/2007 Stefanik ..... 341/176
7,233,316 B2 * 6/2007 Smith et al. ..... 345/157
2006/0227030 A1 * 10/2006 Clifford et al. ..... 341/176
2006/0262001 A1 11/2006 Ouchi et al.

FOREIGN PATENT DOCUMENTS

| | | |
|---|---|---|
| JP | 11-327753 | 11/1999 |
| JP | 2000-132305 | 5/2000 |
| JP | P3298578 | 4/2002 |
| JP | 2003-78779 | 3/2003 |
| JP | 2003-284168 | 10/2003 |

OTHER PUBLICATIONS

U.S. Appl. No. 11/686,003, filed Mar. 14, 2007, Ouchi, et al.

* cited by examiner

*Primary Examiner*—Brian A Zimmerman
*Assistant Examiner*—Hung Q Dang
(74) *Attorney, Agent, or Firm*—Oblon, Spivak, McClelland, Maier & Neustadt, P.C.

(57) ABSTRACT

An appliance control apparatus including an acceleration sensor which senses an acceleration resulting from a user motion; a recognition unit which recognizes a control-object apparatus and a control attribute set to the control-object apparatus from the acceleration sensed by the sensor; a control command generator which generates a control command according to the control attribute recognized by the recognition unit; and a transmitter which transmits the control command generated by the control command generator to the control-object apparatus recognized by the recognition unit.

13 Claims, 15 Drawing Sheets

| APPARATUS | AXIS | VALUE | ANGLE INFORMATION |
|---|---|---|---|
| LAMP | Y | -0.9G | $\theta_1$ |
| AIR CONDITIONER | Y | -0.5G | $\theta_2$ |
| TELEVISION SET | Y | +0.2G | $\theta_3$ |

| ATTRIBOTE | COMMAND | CONTROL |
|---|---|---|
| ON/OFF | ON OFF | ON<br>OFF |
| UP/DOWN | UP DOWN | LAMP; LUMINOUS INTENSITY<br>AIR CONDITIONER: TEMPERATURE<br>TELEVISION SET: VOLUME |
| FORWARD/BACKWARD CARRYING MOTIONS | FORWARD/BACKWARD CARRYING MOTIONS | LAMP: LAMP CHARGING<br>AIR CONDITIONER: OPERATION MODE CHANGING<br>TELEVISION SET: CHANNEL SHIFTING |
| CORRECTION | | RETURN TO PREVIOUS STATE |

*Fig. 10*

| MANIPULATED OBJECT ADDRESS | MANIPULATION COMMAND | CHECK SUM |
|---|---|---|

APPLIANCE CONTROL APPARATUS

CROSS-REFERENCE TO RELATED APPLICATIONS

This application is based upon and claims the benefit of priority from the prior Japanese Patent Application No. 2005-143051 filed on May 16, 2005 the entire contents of which are incorporated herein by reference.

BACKGROUND OF THE INVENTION

1. Field of the Invention

The present invention relates to an appliance control apparatus which is held in a hand of a user or fastened to a body of the user to manipulate an apparatus in accordance with a directly-sensed motion.

2. Description of the Related Art

Generally, since a remote controller is dedicated to each of a plurality of apparatuses, there are a plurality of the remote controllers in a room. In this case, one of the apparatuses is manipulated with the corresponding remote controller which is held in the hand. Often, the controller may be misplaced. Further, a problem arises because there are many remote controllers in the room. In order to solve the problem, a multi-remote controller for manipulating a plurality of the apparatuses has been proposed. In the multi-remote controller, a button for selecting the manipulated-object apparatuses, manipulation buttons for the manipulated-object apparatus, and common manipulation buttons are customized, and the manipulation is performed. Although a plurality of the apparatuses can be manipulated with a single remote controller, the number of buttons on the remote controller increases, and there is needed for a plurality of button manipulations for performing a desired manipulation (see Japanese Patent Application Kokai No 2003-78779).

Other techniques which employ a user gesture for the manipulation have been proposed. For example, a method of analyzing the gesture by picking up the gesture with a camera and performing image processing has been frequently used (see Japanese Patent Application Kokai No. 11-327753). However, in such a method, the user must be always traced with camera, or the user must make a gesture in front of the camera. Therefore, the method has many limitations for use in a general room.

On the other hand, as a method of controlling a plurality of apparatuses without the aforementioned limitations, there is known a method for directly sensing a motion of a body by using an acceleration sensor which is fastened on the body (see Japanese Patent Application Kokai No. 2000-132305).

SUMMARY OF THE INVENTION

According to one aspect of the present invention there is provided an appliance control device for intuitively performing recognition for manipulated objects and manipulation contents from a user gesture by using a construction having a small number of sensors.

According to another aspect of the present invention, there is provided an appliance control apparatus including an acceleration sensor which senses an acceleration resulting from a user motion; a recognition unit which recognizes a control-object apparatus and a control attribute set to the control-object apparatus from the acceleration sensed by the sensor; a control command generator which generates a control command according to the control attribute recognized by the recognition unit; and a transmitter which transmits the control command generated by the control command generator to the control-object apparatus recognized by the recognition unit.

BRIEF DESCRIPTION OF THE DRAWINGS

A more complete appreciation of the invention and many of the attendant advantages thereof will be readily obtained as the same become better understood by reference to the following detailed description when considered in connection with the accompanying drawings, wherein:

FIG. 10 is a view showing examples of control attribute commands recognized by a control attribute recognizing unit 13 according to the embodiment of the present invention;

DETAILED DESCRIPTION OF THE PREFERRED EMBODIMENTS

Figure 1:
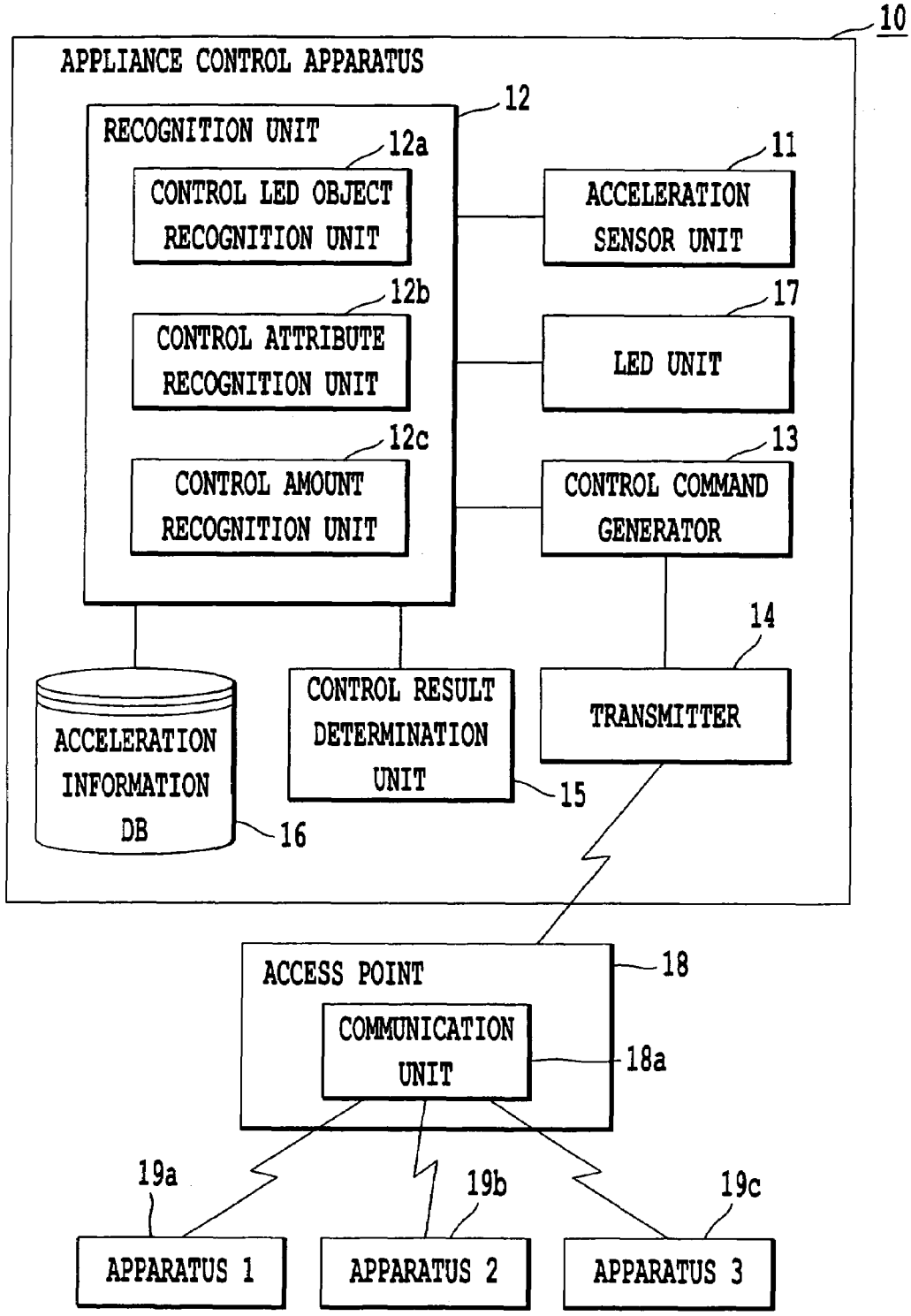
FIG. 1 is a block diagram showing an example of a construction of an appliance control apparatus according to an embodiment of the present invention.

Referring now to the drawings, wherein like reference numerals designate identical or corresponding parts throughout the several views, embodiments of the present invention are next described.

First Embodiment

FIG. 1 is a block diagram showing an appliance control apparatus according to a first embodiment of the present invention. The appliance control apparatus 10 includes an acceleration sensor unit 11, a recognition unit 12, a controlled object recognition unit 12*a*, a control attribute recognition unit 12*b*, a control amount recognition unit 12*c*, a control command generator 13, a transmitter 14, a control result determination unit 15, acceleration information DB 16, and an LED unit 17. An access point 18 includes a communication unit 18*a*. The appliance control apparatus 10 recognizes manipulation content from a user motion and transmits the manipulation content to the access point 18. The access point 18 transmits a control signal to controlled-object apparatuses 1, 2, and 3 (19*a*, 19*b*. and 19*c*), so that manipulation is performed.

Figure 2:
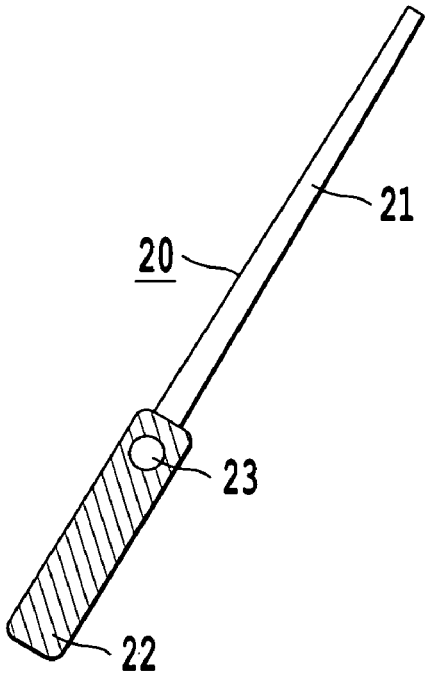
FIG. 2 is a view showing an example of an outer appearance of an appliance control apparatus according to an embodiment of the present invention.
Figure 3:
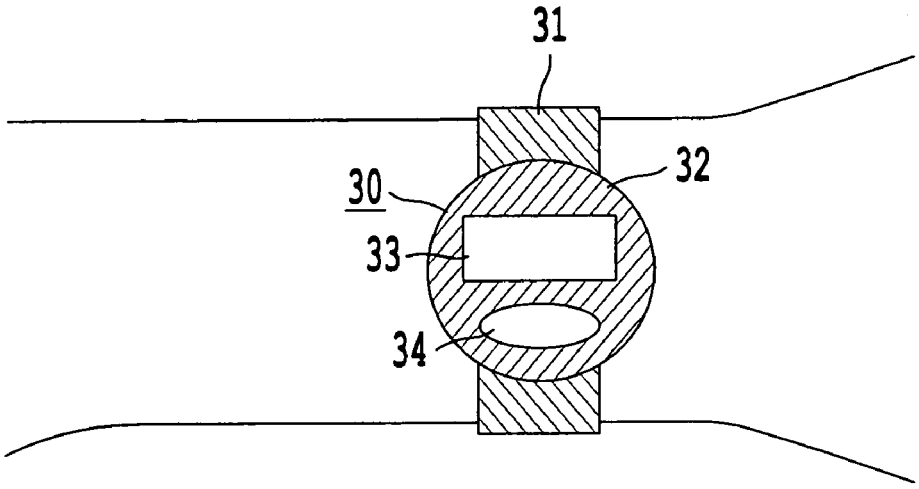
FIG. 3 is a view showing an example of an outer appearance of an appliance control apparatus according to an embodiment of the present invention.

The appliance control apparatus 10 may be a stick-shaped pen/tact-type appliance control apparatus 20 which is held in a hand shown in FIG. 2 or a wristwatch-type appliance control apparatus 30 which is fastened about a wrist shown in FIG. 3.

The stick-shaped appliance control apparatus 20 shown in FIG. 2 includes a distal end portion 21, a handle portion 22, and a push button 23. The acceleration sensor unit 11 (not shown) is disposed at the end of the distal end portion 21. The user holds the handle portion 22 with a hand and allows the thumb to be located on the push bottom 23. In this state, the user manipulates the apparatus by shaking the stick-shaped appliance control apparatus 20.

On the other hand, as shown in FIG. 3, the wristwatch-type appliance control apparatus 30 includes a fastening belt 31, a fastened portion 32, a display portion 33, and a push button 34. The user manipulates the apparatus by shaking an arm on which the wristwatch-type appliance control apparatus 30 is fastened with the fastening belt 31.

In the following discussion, use of the stick-shaped pen/tact-type appliance control apparatus will be described in detail.

In one example, the acceleration sensor unit 11 uses a single acceleration sensor for sensing accelerations in one more axes. Alternatively, a plurality of acceleration sensors may be used. In addition, instead of the acceleration sensor, an angular acceleration sensor may be used. In addition, a combination of acceleration sensors and the angular acceleration sensors for sensing angular acceleration may be used. Where a plurality of the acceleration sensors are used, if the acceleration sensors are disposed at the distal end portion 21 and the handle portion 22 which is held with the hand in the appliance control apparatus 20 shown in FIG. 2, the arm motion and the wrist motion can be easily extracted. According to the present invention, a case where one three-axis acceleration sensor is disposed at the distal end portion 21 will be next described.

In such an embodiment, the transmitter 14 may be a wireless communication unit such as Bluetooth (registered trade mark), but is not limited thereto. Alternatively, the appliance control apparatus and the apparatus may be connected through a wire line.

The communication unit 18*a* receives a control command from the transmitter 14 and transmits a control signal to the manipulated-object apparatus. In a case where communication means between the access point 18 and the manipulated-object apparatus are different from communication means between the transmitter 14 and the communication unit 18*a*, a plurality of communication means may be provided.

Figure 4:
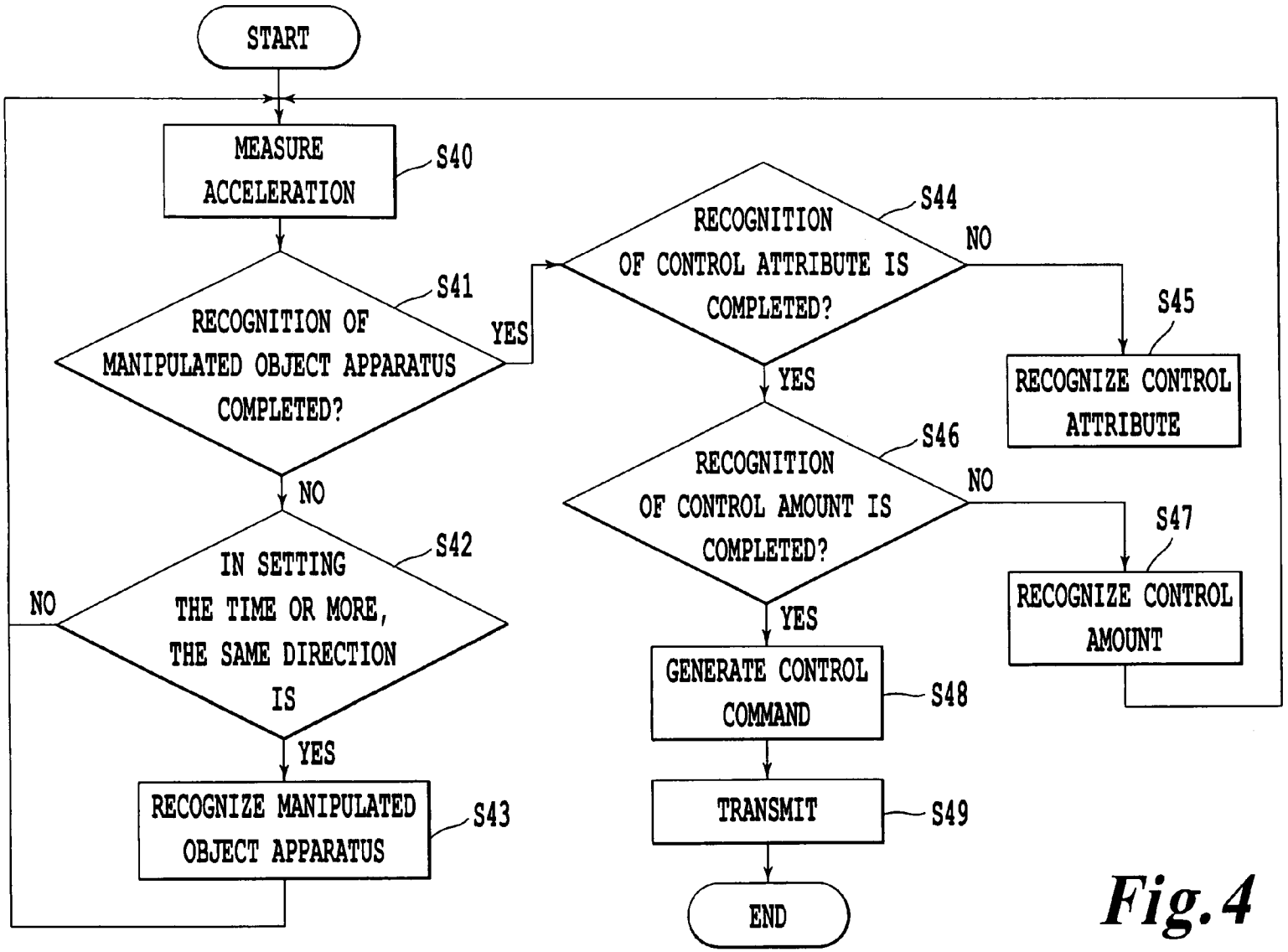
FIG. 4 is a flowchart of processing operations of an appliance control apparatus according to the embodiment of the present invention.

FIG. 4 is a flowchart of processing operations of an appliance control apparatus according to an embodiment of the present invention. Firstly, the recognition unit 12 measures an acceleration which is produced according to a user motion and sensed by the acceleration sensor unit 11 in a predetermined time interval (for example, in units of 50 ms) (Step S40). After the measurement, if recognition of the manipulated-object apparatus is not in a recognition completion state, a manipulated object recognition process is performed by the controlled object recognition unit 12*a*. If the manipulated-object apparatus is in a recognition completion state, a control attribute recognition process proceeds (Step S41). When the user manually manipulates the appliance control apparatus to signal a particular manipulated-object apparatus and then keeps the appliance control apparatus stationary for a predetermined time or more, the recognition unit 12*a* recognizes the signaled apparatus as the manipulated-object apparatus based on the angles of the axes. (Steps S42 and S43). In a case where only the acceleration sensor is used, the apparatus is recognized based on acceleration information (angle information of the appliance control apparatus with respect to the manipulated-object apparatus).

Subsequently, in a case where the control attribute is not recognized, the control attribute recognition unit 12*b* recognizes the control attribute of the manipulated-object apparatus from the acceleration information obtained by the acceleration sensor unit 11 (Steps S44 and S45). In a case where the control attribute is recognized and a control amount is not recognized, the control amount recognition unit 12*c* counts a number of the control attributes recognized by the control attribute recognition unit 12*b*, so that the control amount is recognized (Steps S46 and S47). In a case where the control attribute and the control amount are recognized, the control command generator 13 generates the control command and the control command is transmitted from the transmitter 14 (Steps S48 and S49).

Figures 5, 6A:
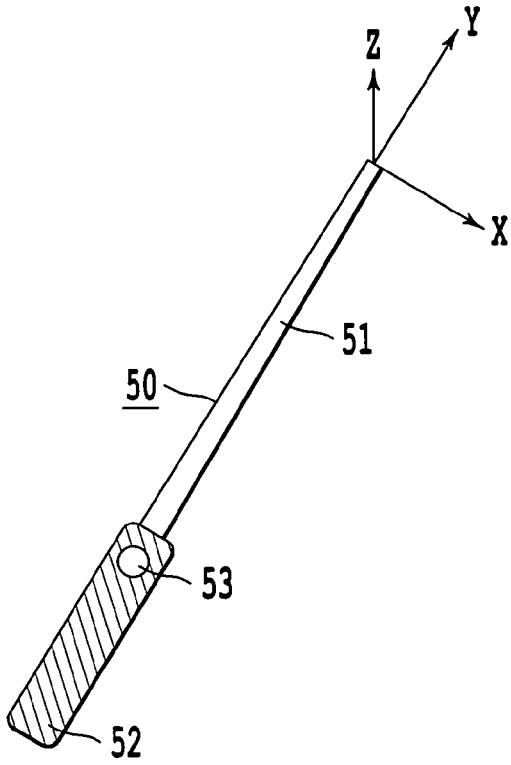
FIG. 5 is a view showing an example of a mounted position and acceleration axis directions of an acceleration sensor in an appliance control apparatus according to the embodiment of the present invention.

Now, an example of recognition of the manipulated-object apparatus will be described. FIG. 5 shows an example of axis directions of the acceleration sensor unit 11 disposed at a distal end portion 51 of an appliance control apparatus 50. When a handle portion 52 is held with the thumb located on a push button 53, the push button is pointed in a direction (Z axis) perpendicular to the stick. If a direction of left and right shaking of the stick and a direction of the distal end portion of the stick are defined as X and Y axes, respectively, an effect of the gravitational acceleration occurs in the Y and Z axes. As a result, an angle with respect to which the user signals by movement of the stick can be estimated from the gravitational acceleration in one or both of the axes. A relation among the apparatuses and the accelerations and the angles of the axes is defined and stored in the acceleration formation DB 16. Before the device is used or when the manipulation position thereof is changed, calibration may be performed. Previous acceleration information may be stored as a recognition number distribution or a probability distribution for the recognized apparatuses, and an apparatus which has a highest recognition number at the associated position may be selected as a candidate.

To perform calibration, particular apparatuses are signaled to the appliance control apparatus, by manipulation of the stick, in a predetermined order of the apparatuses, for example, in an order of a lamp, an air conditioner, and a television set, and the just-before push button 53 is pushed, so that information on the angles and the accelerations of the appliance control apparatus for each apparatus is recorded. In a case where the display portion 33 and the push button 34 are provided in the appliance control apparatus 30 as shown in FIG. 3, they may be used for an input operation. In addition, if a function of connecting to another separate terminal is provided, the information may be transmitted to the appliance control apparatus 10 by setting of the separate terminal.

Figure 6B:
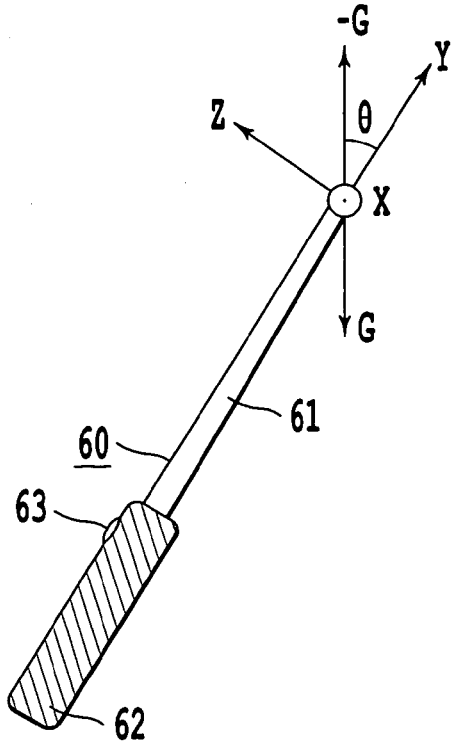
FIG. 6 is a table showing an example of calibration data registration of apparatuses and a relation between Y axis accelerations and angle information of the apparatuses in an appliance control apparatus according to the embodiment of the present invention.

FIGS. 6(*a*) and 6(*b*) show the geometric arrangement by which calibration data are obtained, and an example of calibration data stored in the acceleration information DB 16 in a case where the manipulated-object apparatuses are recognized in only the Y axis, that is, a relation between Y axis accelerations and angle information of the apparatuses. FIG. 6(*a*) shows the calibration data in a case where a lamp, an air conditioner, and a television set are selected as the manipulated-object apparatus. For the lamp, the acceleration is registered as −0.9 G (G denotes the gravitation acceleration), and the angle information is registered as θ1 with respect to the vertical direction. Similarly, for the air conditioner, the acceleration is registered as −0.5 G, and the angle information is registered as θ2; and for the television set, the acceleration is registered as +0.2 G, and the angle information is registered as θ3. Here, based on the registered acceleration information, an apparatus which has a value closet to the acceleration (or angle) directly pointed by the appliance control apparatus 10 may be selected, or an apparatus which has a value corresponding to the acceleration (or angle) directly pointed by the appliance control apparatus 10 in a predetermined range with a +/− margins from the stored acceleration information may be selected.

Figure 7:
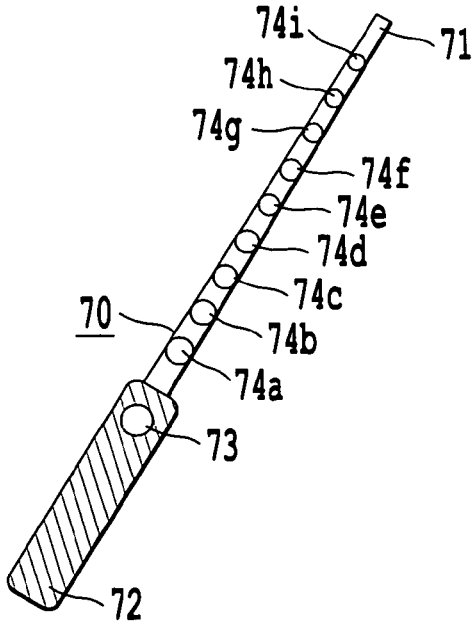
FIG. 7 is a view showing an example of a mounted position of LED in an appliance control apparatus according to the embodiment of the present invention.
Figure 8:
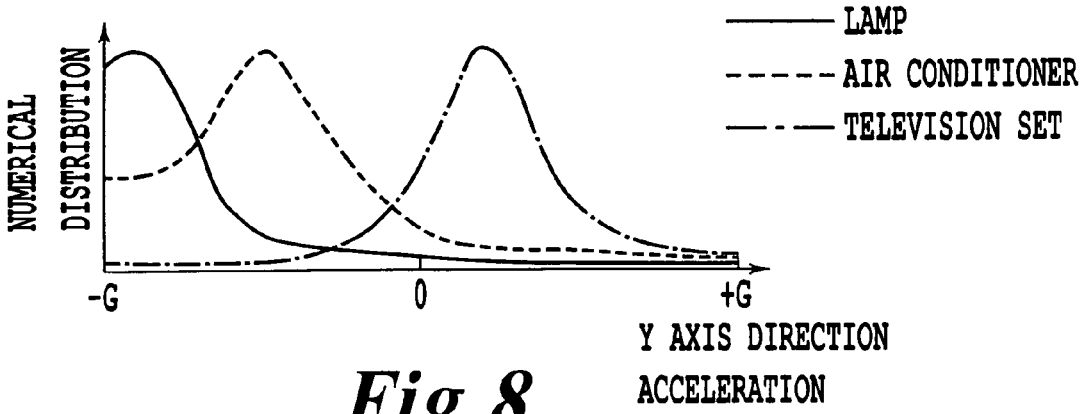
FIG. 8 is a view showing an example of a probability distribution of an Y axis gravitational acceleration when manipulated-object apparatuses are indicated by a controlled-object recognizing unit according to the embodiment of the present invention.

In order to easily recognize the signaled manipulated-object apparatus, a plurality of LEDs 74*a* to 74*i* may be disposed at the distal end portion 71 as shown in FIG. 7, and the display produced by LEDs 74*a*-74*i* may be raised to indicate visually which of the manipulated-object apparatuses has been signaled. For example, when the calibration data for the manipulated-object apparatuses are registered, the LEDs for the manipulated-object apparatuses may be lightened with different colors or patterns for each manipulated-object apparatus. By doing so, the user can memorize a correspondence between the lightening colors and/or patterns and the manipulated-object apparatuses. For example, in a case where two-color (red and green) lightening LEDs are used, that is, in a case where two LEDs are provided to each of the LEDs 74*a* to 74*i*, the LEDs for the lamp may be lightened in green, the LEDs for the air conditioner may be lightened in red, and the LEDs for the television set may be lightened in alternating red and green or in an intermediate color, that is, yellow (lightened simultaneously at the LEDs disposed at the same position). Alternatively, all the previous recognition data for the manipulated-object apparatuses may be stored as a number distribution (or probability distribution) as shown in FIG. 8, and an apparatus which has the highest recognition number with respect to the associated acceleration may be selected as a candidate.

Figure 9:
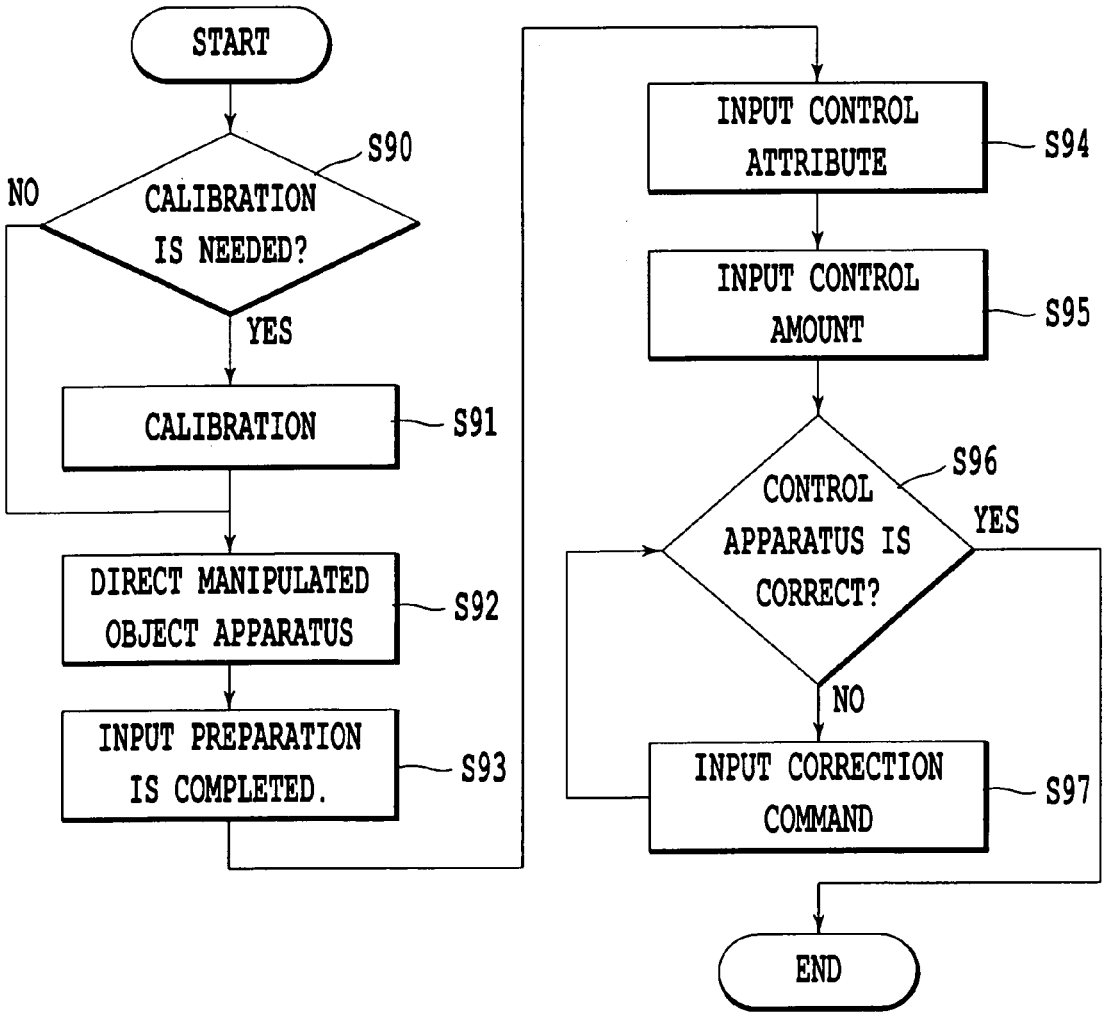
FIG. 9 is a flowchart showing a manipulation procedure of a user according to the embodiment of the present invention.
Figure 11A:
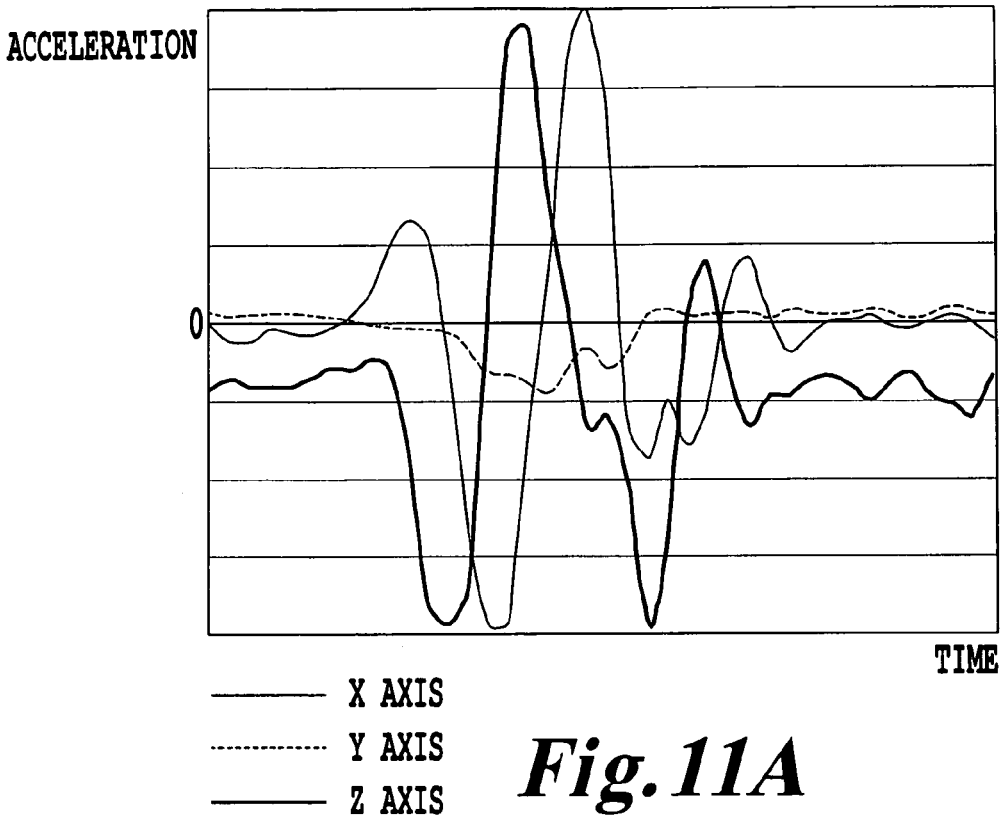
FIGS. 11A and 11B are graphs showing examples of an acceleration change when an ON operation (right rotation) and an OFF operation (left rotation) are performed in an appliance control apparatus according to the embodiment of the present invention.
Figure 11B:
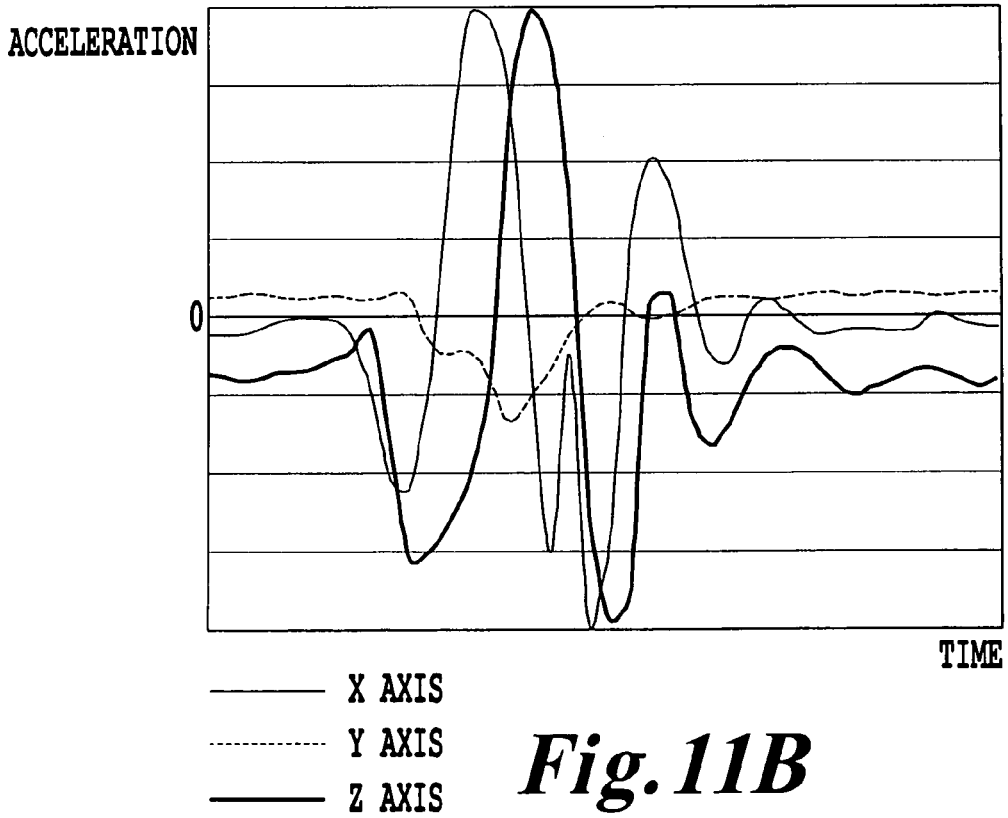

FIG. 9 is a flowchart for explaining a manipulation procedure of a user according to the embodiment of the present invention.

In a case where calibration of the appliance control apparatus 10 is needed such as a case where the appliance control apparatus 10 is initially used and a case where the appliance control apparatus 10 is used at different location, the aforementioned calibration procedure is performed (Steps S90 and S91). After that, in a case where the calibration is not needed (including a case where the number distribution is used), the appliance control apparatus 10 signals the manipulated-object apparatus, and the manipulated-object apparatus directing is performed (Step S92). By the signaling the appliance control apparatus 10 in a predetermined time or more, the manipulated-object apparatus is recognized, and the input preparation for the manipulated-object apparatus is completed (Step S93).

In addition to the recognition of the manipulated-object apparatus, prevention of malfunction can be attained. Namely, after the manipulated-object apparatus is recognized by the signaling thereof in a predetermined time or more, the control attribution recognition, the control amount recognition, and the like are performed, so that undesired input for the manipulated-object apparatus can be reduced.

As a method of easily notifying the use of the recognition of the manipulated-object apparatus after the predetermined time, a plurality of the LEDs disposed as shown in FIG. 7 may be sequentially and gradually lightened from the front LED in colors and lightening patterns corresponding to the signaled manipulated-object apparatuses, and at the stable state, all the LED may be lightened. After the recognition of the manipulated-object apparatus, if no input of the control attribution command is performed and the direction of the appliance control apparatus 10 is changed to signal a different manipulated-object apparatus, the currently pointed manipulated-object apparatus is cancelled, and a newly signaled manipulated-object apparatus is selected as a candidate. The LEDs are turned off, and after that, the LEDs for the new manipulated-object apparatus are lightened in the corresponding color and/or pattern.

After the manipulated-object apparatus is recognized, the input of the control attribute and the control amount are performed (Step S94, S95), and the control attribute recognition unit 12*b* and the control amount recognition unit 12*c* recognize the control attribute and the control amount. As shown in FIG. 10, with respect to the control attribute, common attributes are prepared irrespective of the manipulated-object apparatuses, and the manipulation is performed with the common attributes. In addition, it is preferable that intuitive commands are allocated to the control attribute as shown in FIG. 10. The control amount denotes an amount of the manipulation. For example, if the control attribute is for a blower output of an air conditioner, the control amount may be the level thereof which is slightly changed. In addition, if the control attribute is for a channel of a television set, the control amount may be a number by which the selected channel is changed. The recognition of the control amount is performed with the manipulation number of the control attribute commands. In addition, with respect to a control attribute not involved with the control amount such as ON/OFF, the input of the control amount is not performed.

Figure 12A:
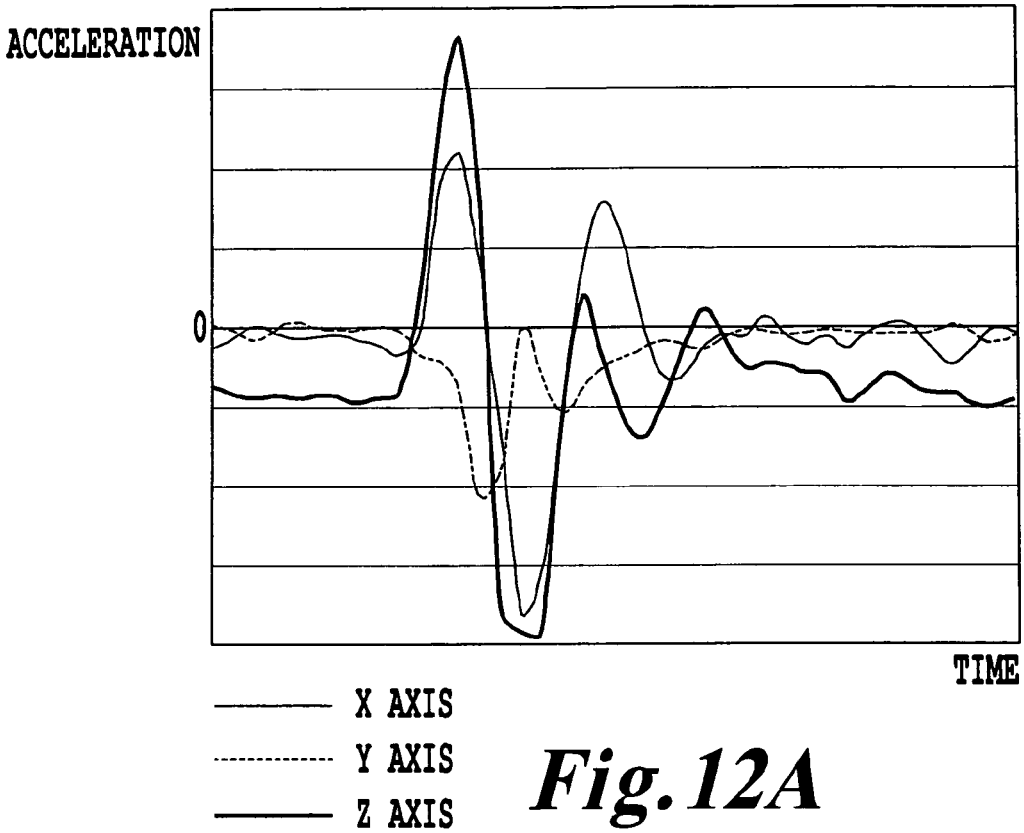
FIGS. 12A and 12B are graphs showing examples of an acceleration change when an UP operation (upward motion) and a DOWN operation (downward motion) are performed in an appliance control apparatus according to the embodiment of the present invention.
Figure 12B:
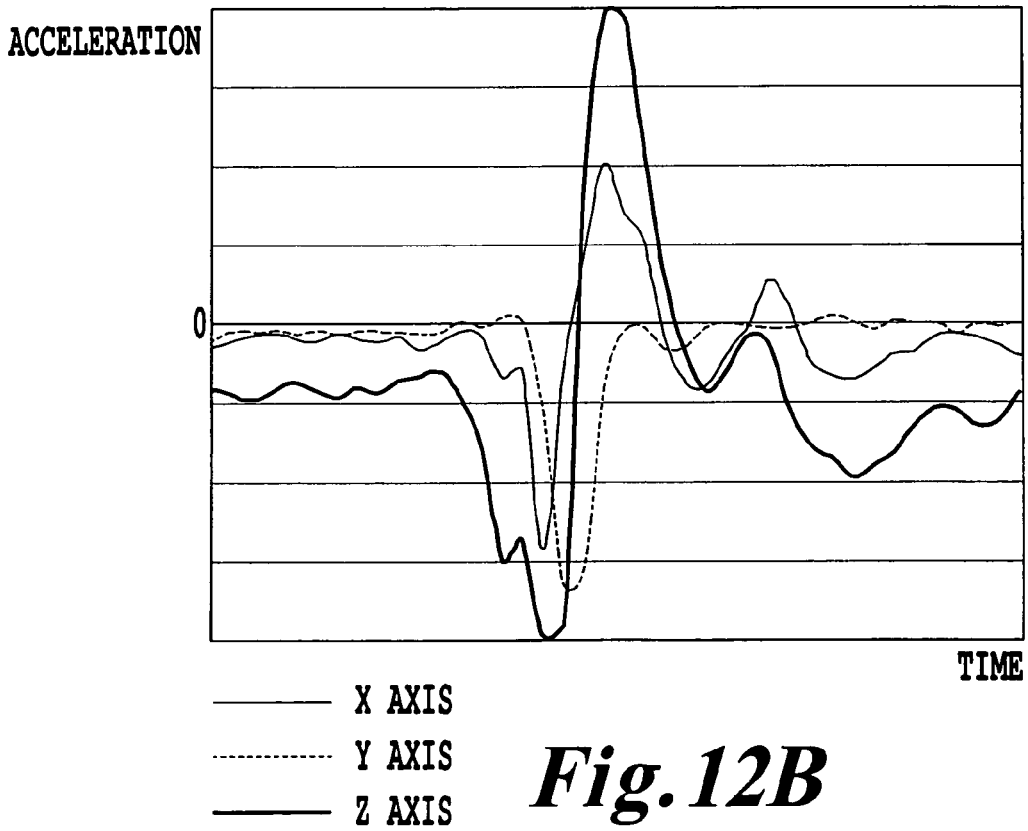
Figure 13A:
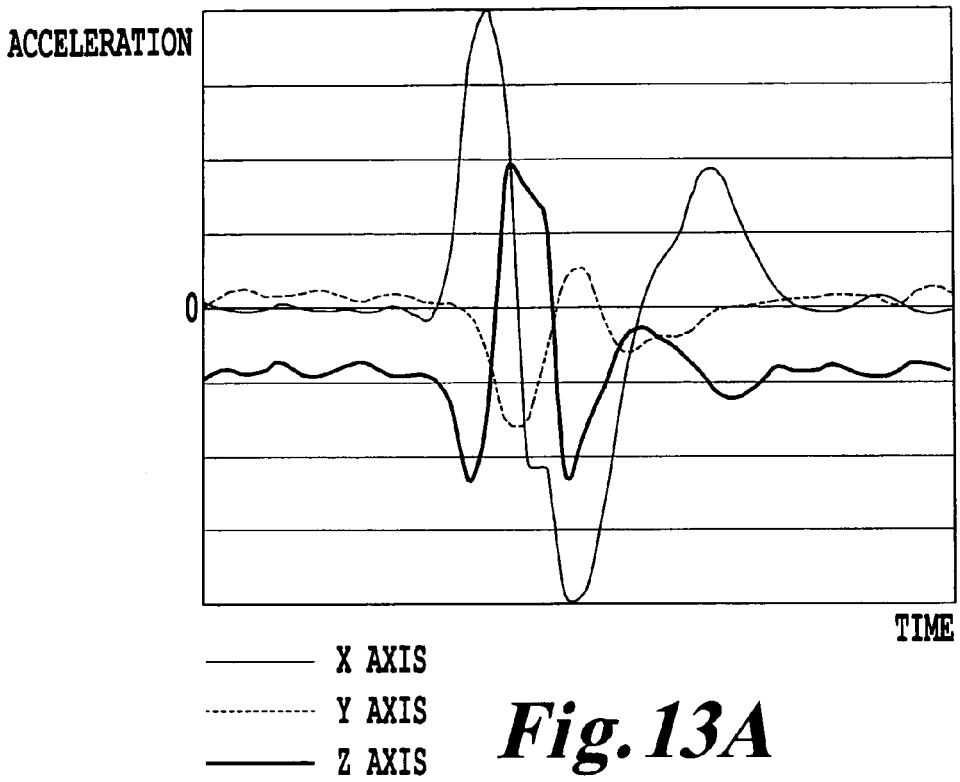
FIGS. 13A and 13B are graphs showing examples of an acceleration change when a FORWARD carrying operation (rightward motion) and a BACKWARD carrying operation (leftward motion) are performed in an appliance control apparatus according to the embodiment of the present invention.
Figure 13B:
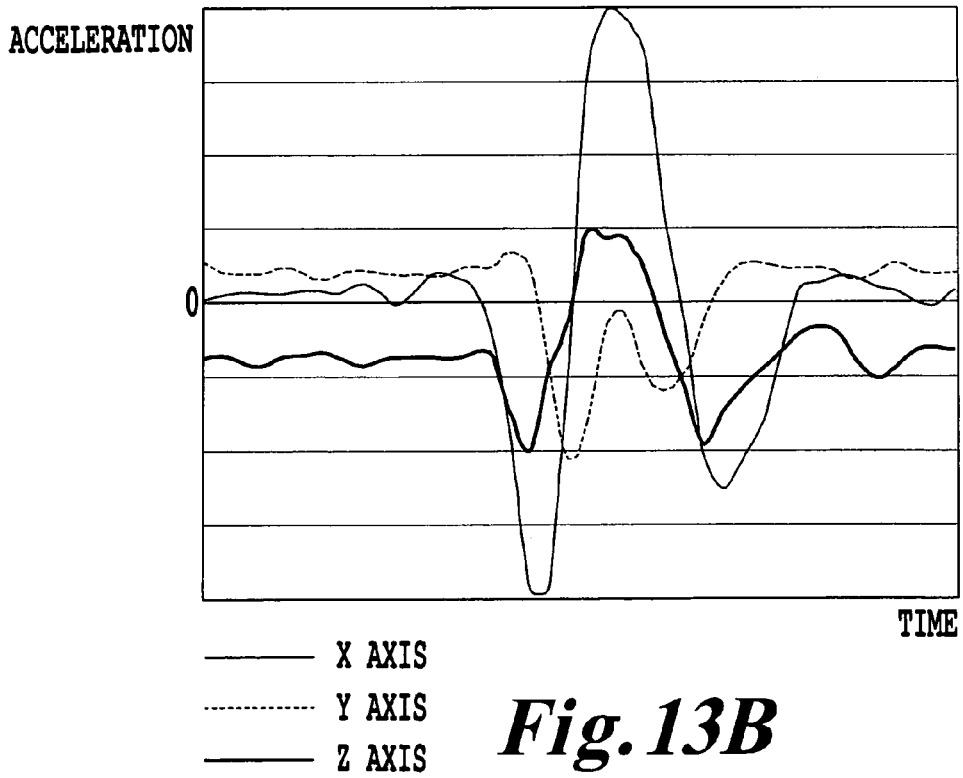

Recognition for 14 types of attribute commands (including a correction command) shown in FIG. 10 is performed as follows. FIGS. 11A to 13B show examples of acceleration waveforms when the attribute commands are performed, and correspond to examples of ON (right rotation) and OFF (left rotation). FIGS. 12A and 12B correspond to examples of DOWN (downward motion) and UP (upward motion). FIGS.

13A and 13B correspond to examples of a backward carrying motion (leftward motion) and a forward motion (rightward motion).

Figure 14A:
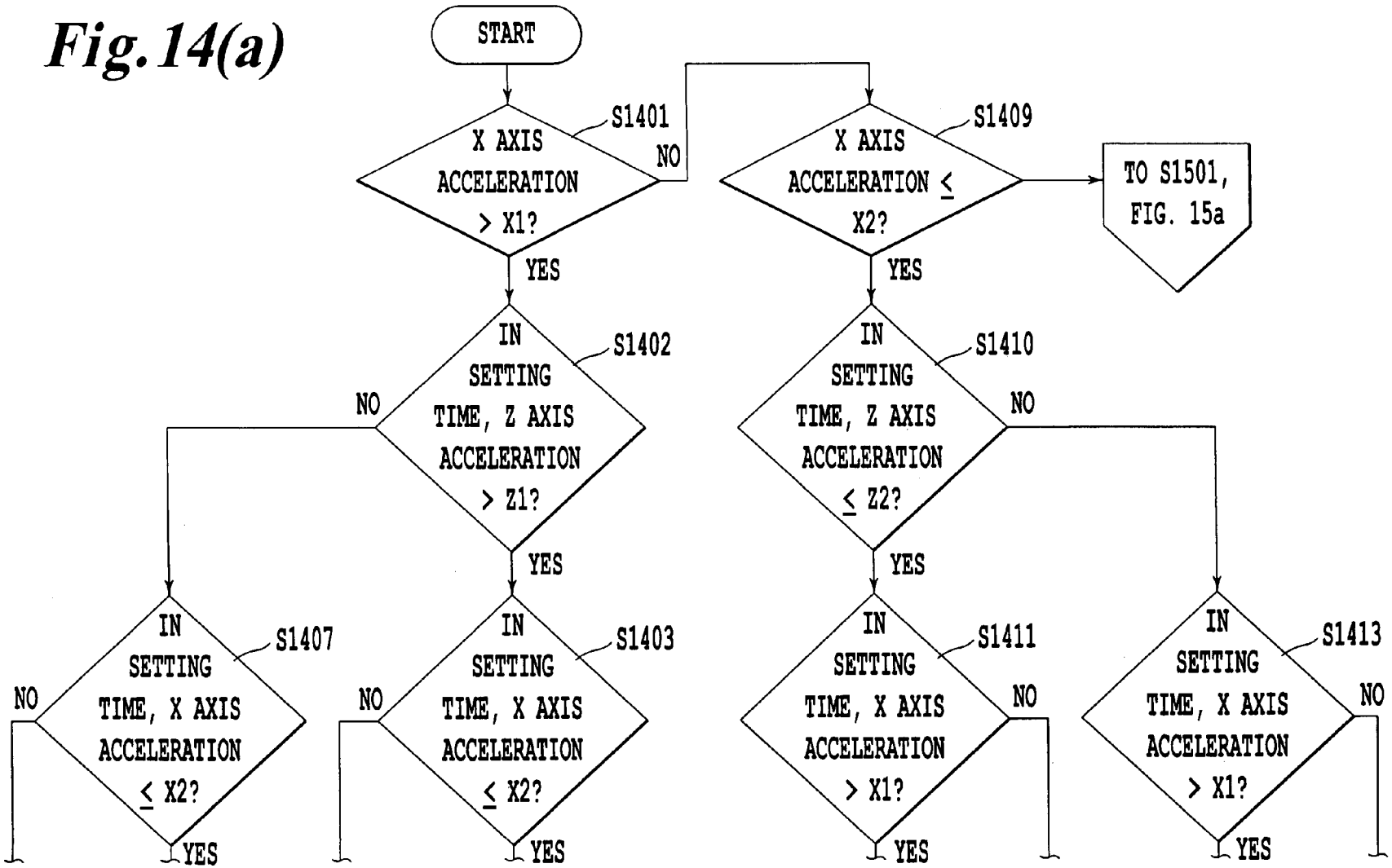
FIG. 14 is a flowchart of a recognition procedure for control attribute recognition according to the present invention.
Figure 14B:
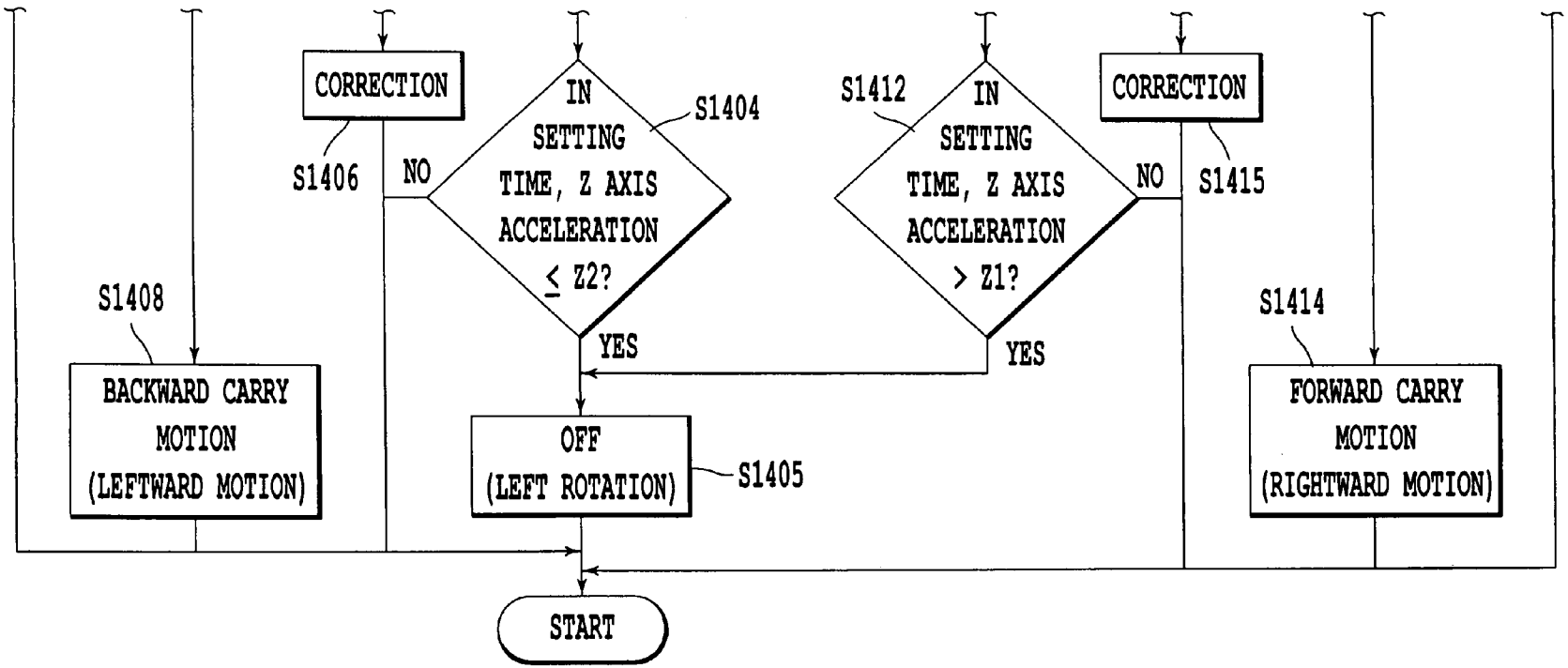
Figure 15A:
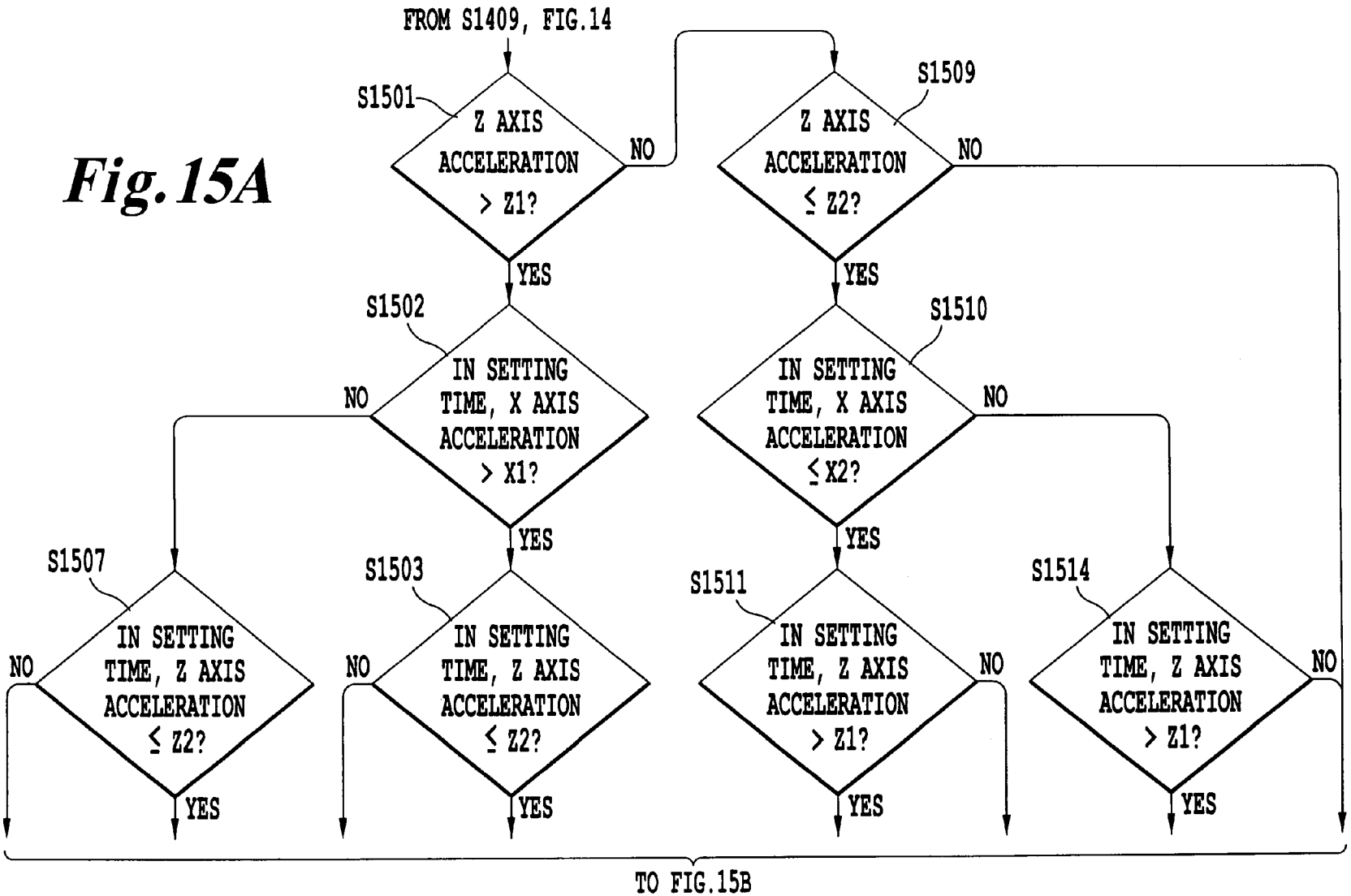
FIG. 15 is a flowchart of a recognition procedure for control attribute recognition according to the present invention.
Figure 15B:
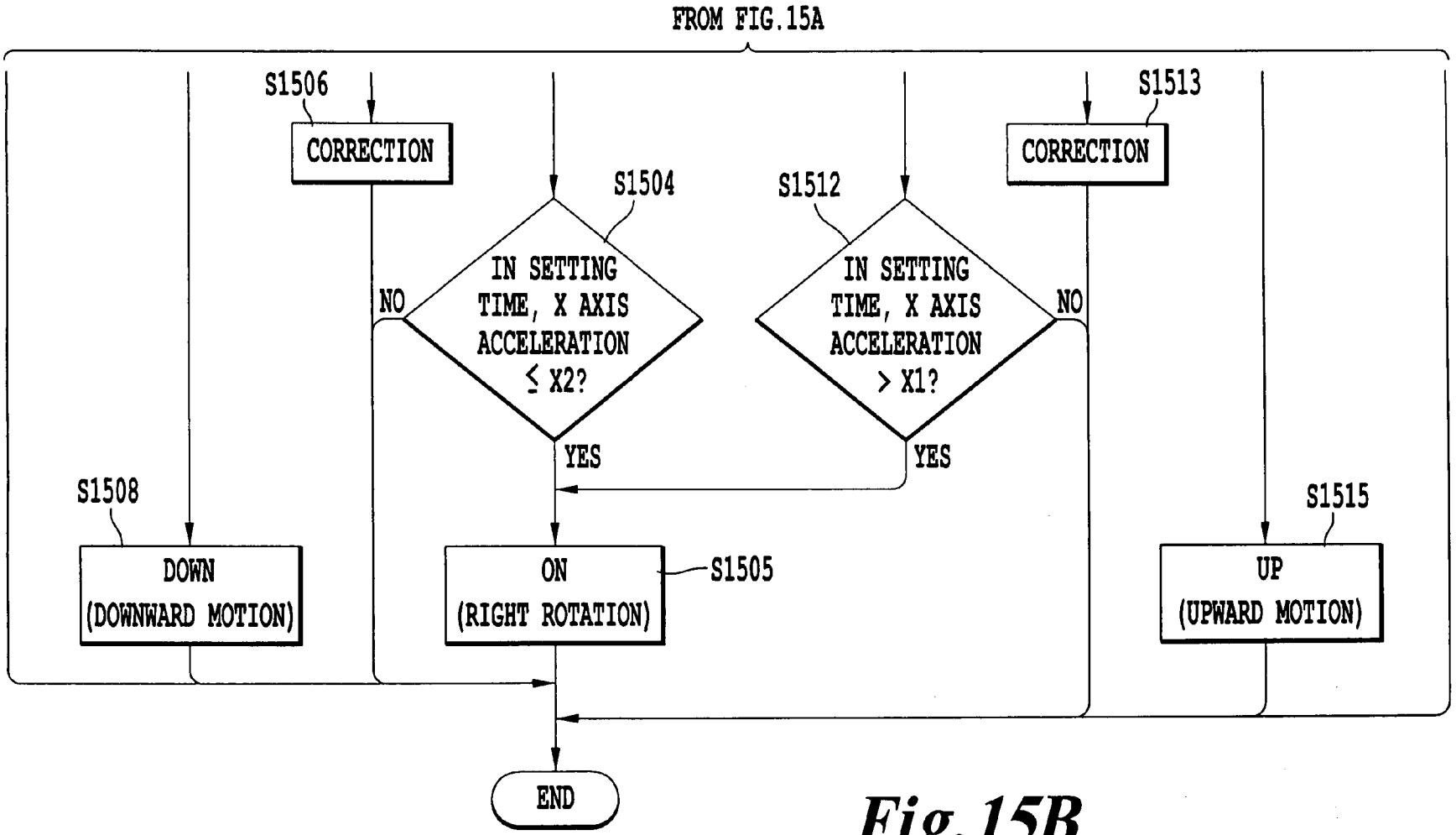

Here, a simple recognition scheme using threshold crossing will be described. The recognition scheme for the control attribute is not limited thereto, and for example a pattern matching scheme based on characteristics of axis waveforms may be used for the recognition. FIGS. 14 and 15 are flowcharts explaining processing operations of the control attribute recognition unit 12*b*.

Recognition for leftward and rightward motions, upward and downward motions, and rotation and correction motions are performed by using X axis acceleration, Z axis acceleration, and a combination thereof, respectively. Firstly, positive thresholds X1 and Z1 (for example, 1.5 G) and negative thresholds X2 and Z2 (for example, −1.5 G) are defined. The recognition process is performed with reference to an axis of which acceleration firstly exceeds one of the thresholds (with respect to the positive threshold, an acceleration exceeding it; and with respect to the negative threshold, an acceleration equal to or less than it)

The flowchart shown in FIG. 14 corresponds to a processing operation where the X axis acceleration firstly exceeds the threshold. When the X axis acceleration exceeds X1 (Step S1401), if the Z axis acceleration subsequently exceeds Z1 in a setting time, the OFF command (left rotation) and the correction command become candidates. If not, the backward carrying command (leftward motion) becomes a candidate (Step S1402). Subsequently, for the OFF command candidate and the correction command candidate, if the X axis acceleration is equal to or less than X2 in a setting time after the Step S1402, the OFF command becomes a candidate. If not, the correction command is recognized (Steps S1403 and S1406). For the OFF command candidate, if the Z axis acceleration is equal to or less than Z2 in a setting time after Step S1403, the OFF command is recognized (Step S1405). If not, the recognition for the control attribute ends (Step S1404). For the backward carrying command candidate, if the X axis acceleration is equal to or less than X2 in a setting time after the Step S1402, the backward carrying command is recognized (Step S1409). If not, the recognition for the control attribute ends (Step S1408).

On the other hand, when the X axis acceleration is equal to or less than X2 (Step S1409), if the Z axis acceleration is subsequently equal to or less than Z2 in a setting time, the OFF command (left rotation) and the correction command become candidates. If not, the forward carrying command (rightward motion) becomes a candidate (Step S1410). Subsequently, for the OFF command candidate and the correction command candidate, if the X axis acceleration exceeds X1 in a setting time after Step S1410, the OFF command becomes a candidate. If not, the correction command is recognized (Steps S1411 and S1415). For the OFF command candidate, if the Z axis acceleration exceeds Z1 in a setting time after the Step S1411, the OFF command is recognized (Step S1405). If not, the recognition for the control attribute ends (Step S1412). In the forward carrying command candidate, if the X axis acceleration exceeds X1 in a setting time after Step S1409, the forward carrying command is recognized (Step S1414). If not, the recognition for the control attribute ends (Step S1413).

Next, the flowchart shown in FIG. 15 corresponds to a processing operation where the Z axis acceleration firstly exceeds the threshold. When the Z axis acceleration exceeds Z1 (Step S1501), if the X axis acceleration subsequently exceeds X1 in a setting time, the ON command (right rotation) and the correction command become candidates. If not, the DOWN command (downward motion) becomes a candidate (Step S1502). Subsequently, for the ON command candidate and the correction command candidate, if the Z axis acceleration is equal to or less than Z2 in a setting time after the Step S1502, the ON command becomes a candidate. If not, the correction command is recognized (Steps S1503 and S1506). For the ON command candidate, if the X axis acceleration is equal to or less than X2 in a setting time after the Step S1503, the ON command is recognized (Step S1505). If not, the recognition for the control attribute ends (Step S1504). For the DOWN command candidate, if the Z axis acceleration is equal to or less than Z2 in a setting time after the Step S1502, the DOWN command is recognized (Step S1508). If not, the recognition for the control attribute ends (Step S1507).

On the other hand, when the Z axis acceleration is equal to or less than Z2 (Step S1509), if the X axis acceleration is subsequently equal to or less than X2 in a setting time, the ON command (right rotation) and the correction command become candidates. If not, the UP command (upward motion) becomes a candidate (Step S1510). Subsequently, for the ON command candidate and the correction command candidate, if the Z axis acceleration exceeds Z1 in a setting time after the Step S1510, the ON command becomes a candidate. If not, the correction command becomes a candidate (Steps S1511). For the ON command candidate, if the X axis acceleration exceeds X1 in a setting time after the Step S1511, the ON command is recognized (Step S1505). If not, the recognition for the control attribute ends (Step S1512). For the UP command candidate, if the Z axis acceleration exceeds Z1 in a setting time after the Step S1509, the forward carrying command is recognized (Step S1515). If not, the recognition for the control attribute ends (Step S1514).

In addition, for the setting times of steps which are differently set from times of the last preceding and next succeeding steps, the control attributes are recognized from the acceleration information in a sequentially-set time. Namely, in the Step S1503, it is determined whether or not the threshold is exceeded in the setting time after the setting time of the Step S1502.

In this manner, the attribute commands for ON/OFF (right rotation/left rotation), UP/DOWN (upward motion/downward motion), forward carrying/backward carrying motion (rightward motion/leftward motion), and correction are recognized. In addition, thresholds may be modified according to characteristics of devices and users.

The control amount is recognized by counting the number of the control attribute commands recognized according to the aforementioned recognition scheme.

Figures 16, 17:
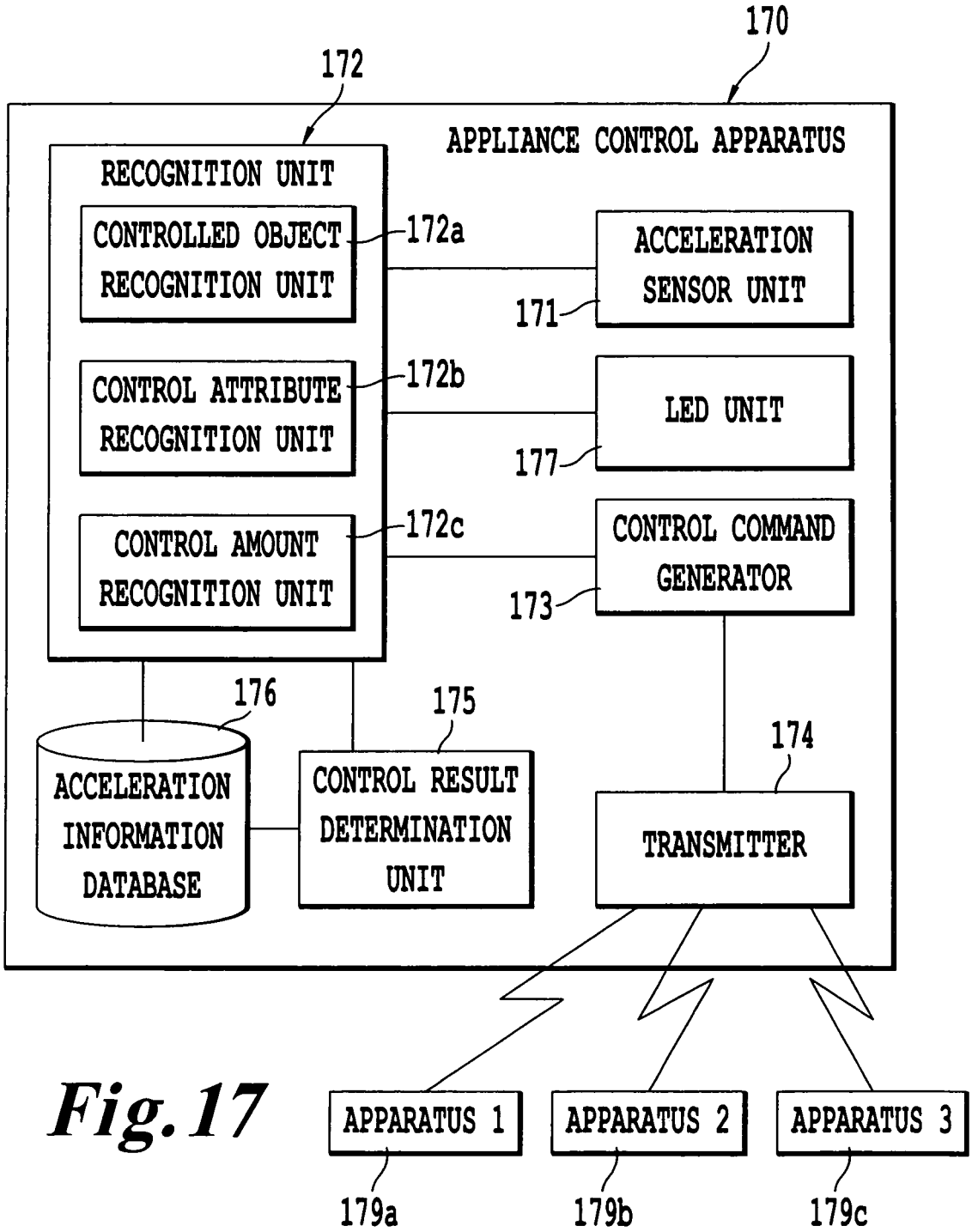
FIG. 16 is an example of a control command generated according to the embodiment of the present invention.
FIG. 17 is a block diagram showing an example of a construction of an appliance control apparatus according to a second embodiment of the present invention.

In the recognition unit 12 constructed with the controlled object recognition unit 12*a*, the control attribute recognition unit 12*b*, and the control amount recognition unit 12*c*, the manipulated-object apparatus, the control attribute, and the control amount are recognized. After that, the control command generator 13 generates the control command having a format, for example, including a manipulated-object apparatus address, a manipulation command, and a check sum as shown in FIG. 16. Next, the control command is transmitted from the transmitter 14 through the access point 18 to the manipulated-object apparatus. In a case where the control is directly performed by using the control command, such construction may be suitable. However, in a case where the control is not directly performed, the control command may be transmitted to a management terminal for managing a plurality of the apparatuses, and the management terminal may convert the control command into control signals for individual apparatuses and control the apparatuses.

As described above, in the manipulation of the manipulated-object apparatuses, if a different apparatus close to the manipulated-object apparatus is erroneously manipulated, the user inputs a correction command. When the input of the correction command is recognized by the control attribute recognition unit 12*b*, the control command generator 13 generates a control command for allowing the erroneously-operated apparatuses to return to its preceding control state, the transmitter 14 transmits the control command. Although only the control command of correcting the to-be-corrected manipulated-object apparatus is transmitted in the example, a control command for manipulating the next candidate apparatus recognized by the controlled object recognition unit 12*a* may be transmitted together with the correction command.

If the control result is correct, there is no need to input any command. In addition, when the correction command is not input, the control result determination unit 15 determines that the recognition for the manipulated-object apparatus is correct. As shown in FIG. 9, where the recognition numerical distribution is used, a new calibration data is registered in the acceleration information DB 16 and used for the next determination for the manipulated-object apparatus.

By so doing, principal operations for a plurality of the apparatuses can be intuitively performed by using one device.

In the above-described embodiment, the recognition for the manipulated-object apparatuses is firstly performed, and after that, the inputs of the control attribute and control amount are performed. However, the opposite order for the apparatuses and the control amount may be used.

Second Embodiment

In the first embodiment, wireless transmitting such as Bluetooth is used for the transmitter 20. However, in a second embodiment, signals the same as those in a conventional infrared remote controller are transmitted.

FIG. 17 is a block diagram showing an example of a construction of an appliance control apparatus according to the second embodiment of the present invention. The appliance control apparatus 170 includes an acceleration sensor unit 171, a recognition unit 172, a controlled object recognition unit 172*a*, a control attribute recognition unit 172*b*, a control amount recognition unit 172*c*, a control command generator 173, a transmitter 174, control result determination unit 175, and control information DB 176. The basic processing operations are the same as those of the first embodiment, and thus, the following description addresses only the different portions.

The transmitter 174 transmits signals same as those of the conventional dedicated remote controller using an infrared LED. When initially uses the remote controller, the user registers names of makers for the manipulated-object apparatuses. If the appliance control apparatus 170 has display and input functions, these functions may be used for input. In addition, if a function of connecting to another separate terminal is provided, the information may be transmitted to the appliance control apparatus 170 by setting of the separate terminal.

The control command generator 173 may be provided with specifications of remote controllers for various makers and apparatuses in advance. In this case, the control command generator 173 generates a control command based on the maker and apparatus information set by the user, and the transmitter 174 directly transmits the control command to the manipulated-object apparatus.

Accordingly, the manipulation can be performed without addition of a special function to existing apparatuses.

However, the transmitter 174 may have such directionality that the malfunction thereof can be prevented. In addition, the transmitter 174 may not have too large of an output so as to prevent malfunction caused by influence such as reflection off a wall.

Numerous modifications and variations of the present invention are possible in light of the above teachings. It is therefore to be understood that within the scope of the appended claims, the invention may be practiced otherwise than as specifically described herein.

What is claimed is:

1. An appliance control apparatus comprising:

an acceleration sensor which senses an acceleration resulting from a user motion;

a storage unit which stores a common control attribute set for a plurality of apparatuses, with the common control attribute set for a plurality of apparatuses corresponding to the sensed acceleration from a user motion;

a recognition unit which recognizes a control-object apparatus and the common control attribute set to the control-object apparatus from the acceleration sensed by the sensor with reference to the storage unit;

said recognition unit includes a control-object recognition unit which recognizes the control-object apparatus from the acceleration sensed by the acceleration sensor and previously-set acceleration information of the control-object apparatus according to the user motion;

wherein the acceleration information includes a recognition number distribution of the acceleration according to the control-object apparatuses, and wherein the control-object recognition unit recognizes a control-object apparatus having a high recognition number distribution;

a control command generator which generates a control command according to the control-object apparatus and the control attribute recognized by the recognition unit; and a transmitter which transmits the control command generated by the control command generator to the control-object apparatus recognized by the recognition unit.

2. The appliance control apparatus according to claim 1, wherein the acceleration information includes accelerations corresponding to the control-object apparatuses, and wherein the control-object recognition unit recognizes a control-object apparatus having the closest acceleration.

3. The appliance control apparatus according to claim 1, wherein the recognition unit comprises:

a control attribute recognition unit which recognizes a control attribute according to a time change of the acceleration sensed by the acceleration sensor.

4. The appliance control apparatus according to claim 1, wherein the recognition unit comprises a control amount recognition unit which recognizes a control amount with respect to a control content recognized by the control attribute recognition unit, and wherein the control command generator generates a control command according to the control amount recognized by the control amount recognition unit.

5. The appliance control apparatus according to claim 3, wherein the control attribute recognition unit recognizes a correction command according to a time change of the acceleration sensed by the acceleration sensor, and wherein the control command generator generates a control command corresponding to the correction command recognized by the control attribute recognition unit.

6. The appliance control apparatus according to claim 5, wherein the control command generated corresponding to the correction command by the control command generator is a control command for allowing the control-object apparatus to return to an immediately preceding control state.

7. The appliance control apparatus according to claim 1, further comprising:

a control result determination unit which determines whether or not the recognition for the control-object apparatus recognized by the recognition unit is correct.

8. The appliance control apparatus according to claim 7, further comprising:

an acceleration information database which stores acceleration information of the control-object apparatus according to the user motion, wherein, when the recognition for the control-object apparatus recognized by the recognition unit is correct, the acceleration for the control-object apparatus recognized by the recognition unit which is sensed by the acceleration sensor is stored as the acceleration information in the acceleration information database.

9. The appliance control apparatus according to any one of claims 1, 2 and 3 to 8, wherein the appliance control apparatus is a stick-shaped device having a distal end portion where the acceleration sensor is disposed and a handle portion.

10. The appliance control apparatus according to claim 9, comprising:

a plurality of LEDs disposed at the distal end portion.

11. The appliance control apparatus according to claim 10, wherein, after the control-object apparatus is recognized by the recognition unit, the LEDs are sequentially lightened from the LED closest to the handle portion along the distal end portion.

12. The appliance control apparatus according to claim 11, wherein, after the LED disposed at the distal end portion is lightened, the recognition unit recognizes the control attribute set to the control-object apparatus.

13. The appliance control apparatus according to claim 10, wherein a plurality of the LEDs are lightened in respective different colors or patterns for each of the control-object apparatuses recognized by the recognition unit.

* * * * *

UNITED STATES PATENT AND TRADEMARK OFFICE

CERTIFICATE OF CORRECTION

PATENT NO. : 7,541,965 B2
APPLICATION NO. : 11/432489
DATED : June 2, 2009
INVENTOR(S) : Ouchi et al.

It is certified that error appears in the above-identified patent and that said Letters Patent is hereby corrected as shown below:

On the title page, Item (73), the Assignee's information is incorrect. Item (73) should read:

-- (73) Assignee: Kabushiki Kaisha Toshiba, Tokyo (JP) --

Signed and Sealed this

Fourteenth Day of July, 2009

John Doll

JOHN DOLL
*Acting Director of the United States Patent and Trademark Office*